United States Patent [19]

Giezeman et al.

[11] Patent Number: 4,910,558

[45] Date of Patent: Mar. 20, 1990

[54] IMAGE TRANSFER AND CONTACT FIXING DEVICE

[75] Inventors: Paulus G. Giezeman, Belfeld; Arnold A. P. M. d'Hondt, Velden, both of Netherlands

[73] Assignee: Oce-Nederland B.V., Netherlands

[21] Appl. No.: 269,498

[22] Filed: Nov. 10, 1988

[30] Foreign Application Priority Data

Nov. 11, 1987 [NL] Netherlands ..... 8702691

[51] Int. Cl.[4] ..... G03G 15/16

[52] U.S. Cl. ..... 355/279

[58] Field of Search ..... 355/200, 271, 277, 279, 355/290, 295

[56] References Cited

U.S. PATENT DOCUMENTS 3,848,204 11/1974 Drangelis et al. ..... 355/277

4,645,327 2/1987 Kimura et al. ..... 355/200

*Primary Examiner*—Joan H. Pendegrass

*Attorney, Agent, or Firm*—Reed Smith Shaw & McClay

[57] ABSTRACT

An image transfer and contact fixing device for a photocopier wherein a photoconductive drum presses against a transfer roller in a first contact zone to transfer a powder image from the photoconductive drum to the transfer roller, and a second contact zone wherein a pressure roller presses the receiving material against the transfer roller to transfer powder image from the transfer roller to the receiving material with a force greater than the force with which the photoconductive drum presses against the transfer roller. In a third contact zone, a cleaning roller presses against the transfer roller and exerts a compensating force on the transfer roller in such manner that the net resulting force experienced by the transfer roller at its axis is substantially zero. Preferably, the contact zones are distributed around the circumference of the transfer roller such that the contact zones are not situated close together and the setting of the magnitude of the contact pressure forces results not only in a regular image transfer being obtained but also in the magnitude of the compensating force not becoming extremely large.

13 Claims, 3 Drawing Sheets

IMAGE TRANSFER AND CONTACT FIXING DEVICE

FIELD OF THE INVENTION

The present invention relates to a device for transferring a powder image from an image support to a receiving material and fixing it thereon and more particularly to a transfer device which is used in electrophotographic copiers.

BACKGROUND OF THE INVENTION

An image transfer and contact fixing device is described in European Patent Application No. 0149860 as having a photoconductive element and a pressure roller for pressing the receiving material and fixing the image thereon. Both of these are pressed against the transfer roller at different points. In this device, the nip between the photoconductive element and the transfer roller is situated straight opposite from the nip between the transfer roller and the pressure roller.

In a device with this configuration, the force with which the photoconductive element is pressed against the transfer roller generally differs from the force with which the pressure roller is pressed against the transfer roller so that a resultant force is exerted on the transfer roller. This resultant force causes the transfer roller to sag if it is conventionally secured at its ends, with the net result that the pressure in the transfer nip is not sufficiently uniform and causes an irregular transfer. The irregular transfer can be further aggravated by the presence of a cleaning roller in the image transfer and fixing device such as is shown in European Patent Application No. 0149860. This roller causes extra sagging in a direction other than that already referred to above.

Various other configurations of image transfer and contact fixing devices are shown in U.S. Pat. No. 4,645,327 and Abstracts of Japanese Patent Application Nos. 59-53873, 59-168482, and 59-81667. These devices show the transfer roller forming various different angles with the photoconductive element, the pressure roller or a cleaning roller. In none of these devices, however, is there any discussion of forces let alone trying to minimize the resultant force on the transfer roller.

If receiving material is passed through a transfer nip in which the pressure is irregular due to sagging, the receiving material can easily be creased. The sagging phenomena causes the most problems in transfer devices equipped with a long transfer roller for copying onto receiving material having a large format.

It would be desirable, therefore, to have an image transfer and contact fixing device which eliminates the sagging problem.

SUMMARY OF THE INVENTION

Generally the present invention provides a device for transferring a powder image from an image support to a receiving material and fixing it thereon comprising a rotatable transfer roller and a plurality of other rollers which are pressed against the transfer roller, all of the rollers having their axes of rotation substantially parallel to the axis of rotation of the transfer roller, such that a plurality of contact zones are formed between the transfer roller and each other roller, a first contact zone for the transfer of the powder image from the image support to the transfer roller and a second contact zone for the transfer of the powder image to the receiving material, and wherein the firs contact zone and the second contact zone are not situated straight opposite one another on the transfer roller, and wherein a resultant force from all the other rollers being pressed against the transfer roller is substantially equal to zero at the axis of rotation of the transfer roller. Preferably, all of the other rollers pressed against the transfer roller are so shaped and pressed against the transfer roller that they form a substantially straight contact zone when considered in the longitudinal direction of the rollers. The phrase substantially straight contact zone in this context means a contact zone of which the width (i.e., the distance between its edges measured in the circumferential direction of the rollers) is substantially the same over the entire length of the zone. Preferably, at least one of the other rollers pressed against the transfer roller is cambered and the force with which that roller is pressed into contact with the transfer roller is exerted on the roller ends, thereby enabling the surface of the roller to be straightened in the contact zone. As a result, the roller in question need not be made stiff and hence need not be made heavy and/or thick in order t form a substantially straight contact zone.

Other details, objects and advantages of the present invention will become more readily apparent from the following description of a presently preferred embodiment thereof.

BRIEF DESCRIPTION OF THE DRAWINGS

In the accompanying drawings, a preferred embodiment of the present invention is illustrate, by way of example only, wherein.

DESCRIPTION OF THE PREFERRED EMBODIMENT

Figure 1:
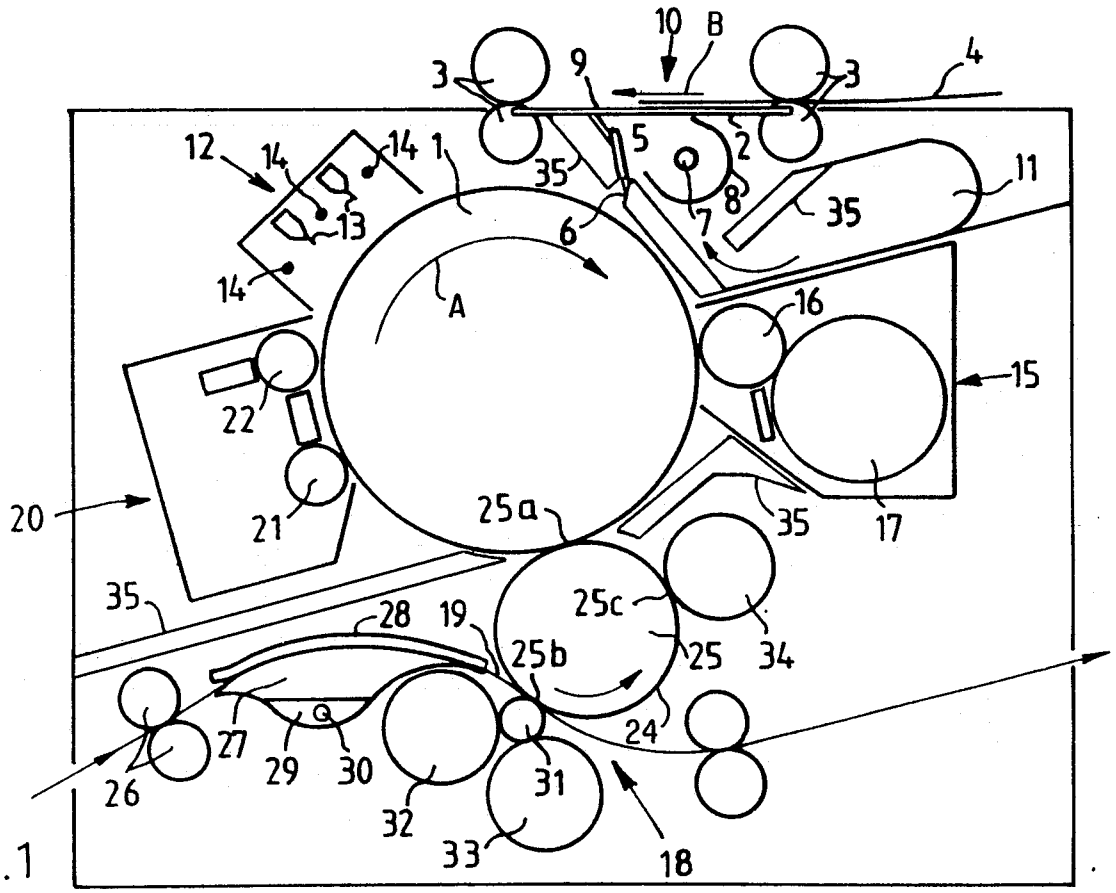
FIG. 1 is a diagrammatic cross-section of an electrophotographic copying machine in which a transfer device of the present invention can be used.

The electrophotographic copying machine represented in FIG. 1 comprises a photoconductive drum 1 which can rotate in the direction of the arrow A. A glass plate 2 is disposed some distance above the drum 1. By means of pairs of rollers 3 an original 4 can be fed over the glass plate 2 in the direction of arrow B. An imaging unit 10 is disposed between the glass plate 2 and the drum 1 and comprises a glass fiber objective 5 consisting of one or more arrays of image-forming glass fibers. The optical axes of the glass fibers intersect the drum axis at some distance. On the side of the glass fiber objective 5 away from the glass plate 2, a mirror 6 is disposed at an angle such that the mirror projects the beam of light formed by the glass fiber objective 5 perpendicularly on the photoconductive drum 1. A tubular light source 7 is disposed next to the glass fiber objective 5. A reflector 8 which partially surrounds the light source 7, and a mirror 9 disposed on the side of the glass fiber objective 5 situated opposite the light source 7, concentrate the light emitted by the light source 7 in the field of view of the glass fiber objective 5. With the imaging unit 10 as described above, an air feed duct 11 is provided from which cooling air can flow through the exposure unit to dissipate the heat produced by the light source 7.

During operation, the rotating photoconductive drum 1 successively passes: (a) a charging station 12 constructed with two rows o corona pins 13 with earthed wires 14 therebetween which is used for the uniform charging of the photoconductive surface of the drum 1; (b) the imaging unit 10 for the image-wise discharge of the charged surface; (c) a developing station 15 with a magnetic developing roller 16 and a feed system 17 for developing the resulting charge image with a single-component magnetizable developing powder; (d) a transfer and fixing station 18 for the transfer of the resulting powder image to a receiving material 19; and (e) a cleaning station 20 for removing remaining toner from the photoconductive drum 1 with a first magnetic roller 21 for neutralizing the charge on the toner and a second magnetic roller 22 for removing the discharged toner from the photoconductive drum 1.

The transfer and fixing station 18 comprises an image transfer roller 25 covered with a layer of silicone rubber 24 and internally provided with a heating element (not shown) to heat the silicone rubber layer 24. In first contact zone 25*a* the drum 1 is pressed against the image transfer roller 25. The force required for the contact pressure in the first contact zone 25*a* may vary within rough limits but is preferably kept as low as possible in order to obtain maximum life of the rubber layer 24. The minimum force required for transferring the powder image from drum 1 to the transfer roller 25 depends on various factor including the deformability of the silicone rubber. A force of 750 N/m of roller length is usually ample.

The receiving material 19 is fed by a pair of transport rollers 26 between the top wall of a reservoir 27 and a contact-pressure member 28. Reservoir 27 contains a quantity of water 29 which can be brought to the boil by a heating element 30, the resulting steam uniformly heating the top wall of the reservoir 27 and also uniformly heating receiving material 19. This receiving material 19 is then pressed against the image transfer roller 25 by means of a pressure roller 31 in a second contact zone 25*b* with a much higher force than that with which the image transfer roller 25 is pressed against the photoconductive drum 1. The magnitude of the force required depends inter alia on the temperature of the powder image and on the melting temperature of the developing powder. A force of about 1500 N/m of roller length is usually sufficient to fix a powder image which has been softened to near melting temperature by a temperature rise. The pressure roller 31 is pressed against the image transfer roller 25 by means of two support rollers 32 and 33.

A cleaning roller 34 for the removal of any toner or receiving material dust remaining on the image transfer roller 25 after fixing is also in contact with the image transfer roller 25. This third contact zone 25*c* is in a part of the circumference of the transfer roller 25 which when considered in the direction of rotation thereof, is situated past the fixing nip. As will be explained hereinafter, the cleaning roller 34 is so positioned and pressed into contact with transfer roller 25 that the resulting force on the shaft ends of the image transfer roller 25 is substantially equal to zero.

Heat-insulating elements 35 are disposed between the heat-producing parts of the copying machine such as the imaging station 10 and the transfer and fixing station 18, and the rest of the machine, in order to keep the rest of the machine cool, particularly the photoconductive drum 1.

The structure of the transfer fixing device of the present invention will now be explained with reference to FIG. 2. The image transfer roller 25 is provided with journals 36 at the ends which are mounted in the frame of the copying machine. The imaging unit 10 with the parts shown in FIG. 1 is also fixedly secured to the frame of the copying machine. Support rollers 37 are secured so as to be freely rotatable on either side of the imaging unit 10. The axes of rotation of the support rollers 37 are situated on a line passing through the plane that perpendicularly intersects the image formed by the glass fiber objective 5. Apart from a strip at the two edges, the cylindrical surface of the photoconductive drum 1 is coated with a photoconductive layer. The support rollers 37 are in contact with the non-coated strips of the photoconductive drum 1 and keep the glass fiber objective 5 at a constant distance from the drum 1 which is required for proper image formation. During copying, the photoconductive layer of the photoconductive drum 1 is in contact with the silicone rubber layer of the image transfer roller 25. In this copying state, the extension of the incident light beam passes through the axis of the drum 1.

The charging device 12 is slidably secured in the copying machine (by a means not shown) for movement towards and away from the photoconductive drum 1 in a radial pane thereof. Support rollers 38 are mounted to be freely rotatable on either side of the charging device 12. The support rollers 38 are pressed against the non-coated strip of the photoconductive drum 1 by means of springs 39 pressing against the charging device 12. As a result, drum 1 in turn presses against both the support rollers 37 which are rotatable about their fixed axes and against the image transfer roller 25 which is rotatable about its fixed axis.

The developing unit 15 and the cleaning unit 20, like the charging unit 12, are slidably secured in the copying machine for movement towards and away from the photoconductive drum 1 and are each provided with support rollers 40 and 41, respectively, which are in contact with those strips of the photoconductive drum 1 which are not covered with photoconductive material. The developing unit 15 and the cleaning unit 20 are pressed against the photoconductive drum 1 by springs 42 and 43, respectively, by a force which is considerably less than the force with which the charging unit 12 is pressed against the photoconductive drum 1.

The forces which which the support rollers 40, 41 and 38 are pressed against the photoconductive drum 1 are set so that the net force with which the drum presses against the image transfer roller 25 is 750 N/m of roller length. This force is exerted primarily by the relatively strong spring 39 because the relatively slack springs 42 and 43 substantially cancel out the effect of one another.

A felt strip 49 moistened with silicone oil is in contact with each of the nonphotoconductive strips of the photoconductive drum 1 with which the support rollers 37, 38, 40 and 41 come into contact. The oil spread on these contact surfaces mixes with any toner present there and prevents any build-up of a layer of toner on the running surfaces for the rollers 37, 38, 40 and 41 so that the position of the units 10, 12, 15 and 20 pressed against the photoconductive drum 1 may be kept exactly equal with respect to the drum.

Since the support rollers 40 and 41 are situated approximately opposite one another, the force with which support rollers 38 are pressed against the photoconductive drum 1 by springs 39 is substantially the sole determining factor for the pressure occurring in the contact zone between the photoconductive drum 1 and the image transfer roller 25. If the photoconductive drum 1 is made sufficiently stiff, it will transmit the force of the springs 39 to the contact zone between the photoconductive drum 1 and the image transfer roller 25 without itself undergoing any substantial deformation.

The support rollers 32 and 33 are mounted at their ends in a subframe 43 rotatable about a spindle 44 which is secured immovably to the frame of the copying machine. A prestressed compression spring 45 disposed between the subframe 43 and the main frame of the copying machine presses the support rollers 32 and 33 against pressure roller 31, which in turn presses against image transfer roller 25. The cleaning roller 34 is mounted at its ends in a subframe 46 rotatable about a spindle 47 which is secured immovably to the frame of the copying machine. A prestressed compression spring 48 disposed between the subframe 46 and the main frame of the copying machine presses the cleaning roller 34 against the image transfer roller 25.

The support rollers 32 and 33 and likewise, the supporting cleaning roller 34 are made considerably thinner than the photoconductive drum 1 and have a much lower resistance to flexure than the photoconductive drum 1. The pressure of the compression springs on the ends of the rollers 32, 33 and 34 will cause these rollers to deform and sag slightly. Despite this sagging, a straight contact zone may nevertheless be obtained between the support rollers 32, 33 and the pressure roller 31, between the pressure roller 31 and the image transfer roller 25, and between the supporting cleaning roller 34 and the image transfer roller 25 if the rollers 32, 33 and 34 are barrel-shaped or cambered with the difference in diameter between the middle and the ends of these rollers being such that with the spring forces applied, the surface of these rollers is straightened in the contact zone.

The difference in diameter required between the middle and the ends of the support rollers 32, 33 and 34 is dependent upon the physical characteristics of the rollers such as their diameters, wall thickness, lengths, type of materials, etc. In the case of a steel roller, for example, having a diameter of 55 mm, a wall thickness of 5 mm, and a length of 930 mm, the diameter of the roller is 0.45 mm larger in the middle than at the ends.

A cam disc 50 is mounted rotatably on each journal 36 of the image transfer roller 25. The cam discs 50 are interconnected by a yoke 51 extending over part of the cylindrical surface of the image transfer roller 25. Near each end of the image transfer roller 25 the yoke 51 is provided with two freely rotatable rollers 52 which project slightly above the yoke and which can be brought into contact with the nonphotoconductive strips of the photoconductive drum 1 by rotation of the cam discs 50.

Rollers 56 and 57 are mounted in the subframes 43 and 46, respectively. These rollers 56 and 57 can be in contact with the cam discs 50 depending upon the position of these discs. The cam discs 50 can be rotated together with the yoke 51, by means of a drive 53, and can be stopped in four different angle positions. In the position of the cam discs 50 shown in FIG. 2, the copying machine is in the copying mode. In this position the rollers 56 and 57 are both at a slight distance from a part of the circumference of the cam disc 50 which has a small diameter. In this position springs 45 and 48, respectively, hold the pressure roller 31 and cleaning roller 34, respectively, with the required force against the image transfer roller 25 while the photoconductive drum 1 is pressed against the transfer roller 25 mainly by springs 39. In this copying position, the image transfer roller 25 can be driven by a suitable drive (not shown) which engages journal 36. When the image transfer roller 25 is driven, the photoconductive drum 1 and the rollers 31 and 34 are rotated by the frictional contact between them and the silicone rubber layer of the image transfer roller 25. If the other copying conditions are satisfied, e.g., the temperature of the image transfer roller 25 and of the paper preheating unit 27–30, an image of an original 4 can be transferred to a receiving material 19.

Figure 2:
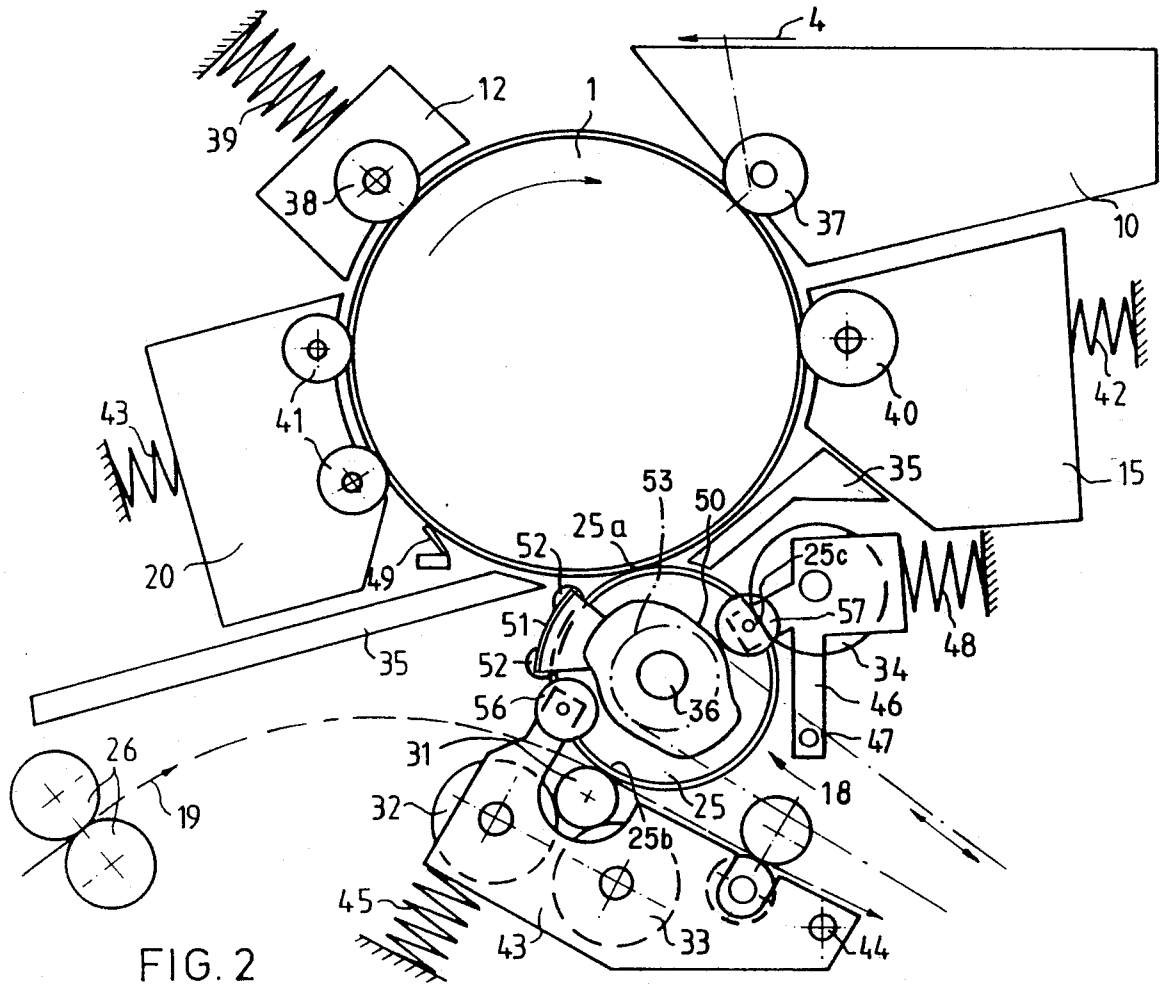
FIG. 2 is a diagrammatic cross-section of the electrophotographic copying machine shown in FIG. 1 which uses a transfer device of the present invention.

On completion of the copying operation, the copying machine is brought into a position of readiness by rotation of the cam discs 50 in the clockwise direction from the position shown in FIG. 2 until all the rollers 52 are in contact with the photoconductive drum 1. In doing so, the drum is pressed up against the force of the springs, and particularly springs 39, with the drum rotating about the support rollers 37. At the same time, yoke 51 is pushed into the space created between the photoconductive drum 1 and the image transfer roller 25 to form a heat-insulating shield between the relatively hot image transfer roller 25 and the photoconductive drum 1 which must be kept cooler. This shield largely fills the space between the heat-insulating elements 35.

On further rotation of the cam discs 50 in the clockwise direction, raised parts of the cam discs 50 situated opposite one another also come into contact with rollers 56 and 57, respectively. Subframes 43 and 46 are thus pressed outwards against the force of compression springs 45 and 48, respectively, so that the support rollers 32 and 33 with the pressure roller 31 resting thereon, and the cleaning roller 34 are moved away from the image transfer roller 25. This is the position to which the cam discs 50 is set when the copying machine is completely switched off.

The cam discs 50 can also be rotated in the counterclockwise direction from the position shown in FIG. 2 into a position in which only rollers 56 are pressed outwards by the raised parts of the cam discs 50 as a result of which only the pressure roller 31 is released from the image transfer roller 25. In this state, a layer of toner can be transferred from the developing station 15 via the surface of the photoconductive drum 1 and the silicone rubber surface of the image transfer roller 25 to the cleaning roller 34. This activity should be done periodically with a cleaning roller as described in European Patent Application No. 0149860 to give a good cleaning effect.

In a preferred embodiment of a copying machine provided with a transfer device according to the present invention, the photoconductive drum has a diameter of 200 mm. This is the minimum diameter required to enable there to be placed around the photoconductive drum the image-forming units for charging, imaging, developing, transfer and cleaning, of a size normally used in electrophotographic copiers. In this embodiment, the image transfer roller 25 is provided with a compressible silicone rubber coating and has a diameter of 100 mm. This is the maximum diameter which can still give a roller that can be readily handled in terms of weight, a feature which is important when a worn roller is replaced by a service engineer. The pressure roller 31 which is provided with a relatively less compressible coating and which cooperates with the image transfer roller 25 has a diameter of 25 mm. Since the diameter of the "hard" pressure roller is considerably smaller than the diameter of the "soft" image transfer roller, a receiving material fed through the nip between the image transfer roller nd the pressure roller is readily released from the image transfer roller after passing through the nip.

In the embodiment with the diameters selected for the photoconductive drum and the image transfer roller, as described above, the angle between a first radial plane of the image transfer roller which passes through the first contact zone 25*a* and a second radial plane of the image transfer roller which passes through the second contact zone 25*b* must be approximately 120° as a minimum. With a smaller angle there is insufficient space to pass receiving material to the fixing nip. The angle between the first radial plane and a third radial of the image transfer roller which passes through the cleaning roller is preferably 75° as a minimum to provide sufficient space, for example, for a heat-insulating element between the photoconductive drum 1 and the supporting cleaning roller 34. In this preferred embodiment, the angle between the photoconductive drum and the pressure roller is set to 135° and the range between the photoconductive drum and the cleaning roller is set to 75°. Also, as already stated, the force between the photoconductive drum and the image transfer roller is set to 750 N/m and the force between the transfer roller and the pressure roller 1500 N/m.

Figure 3:
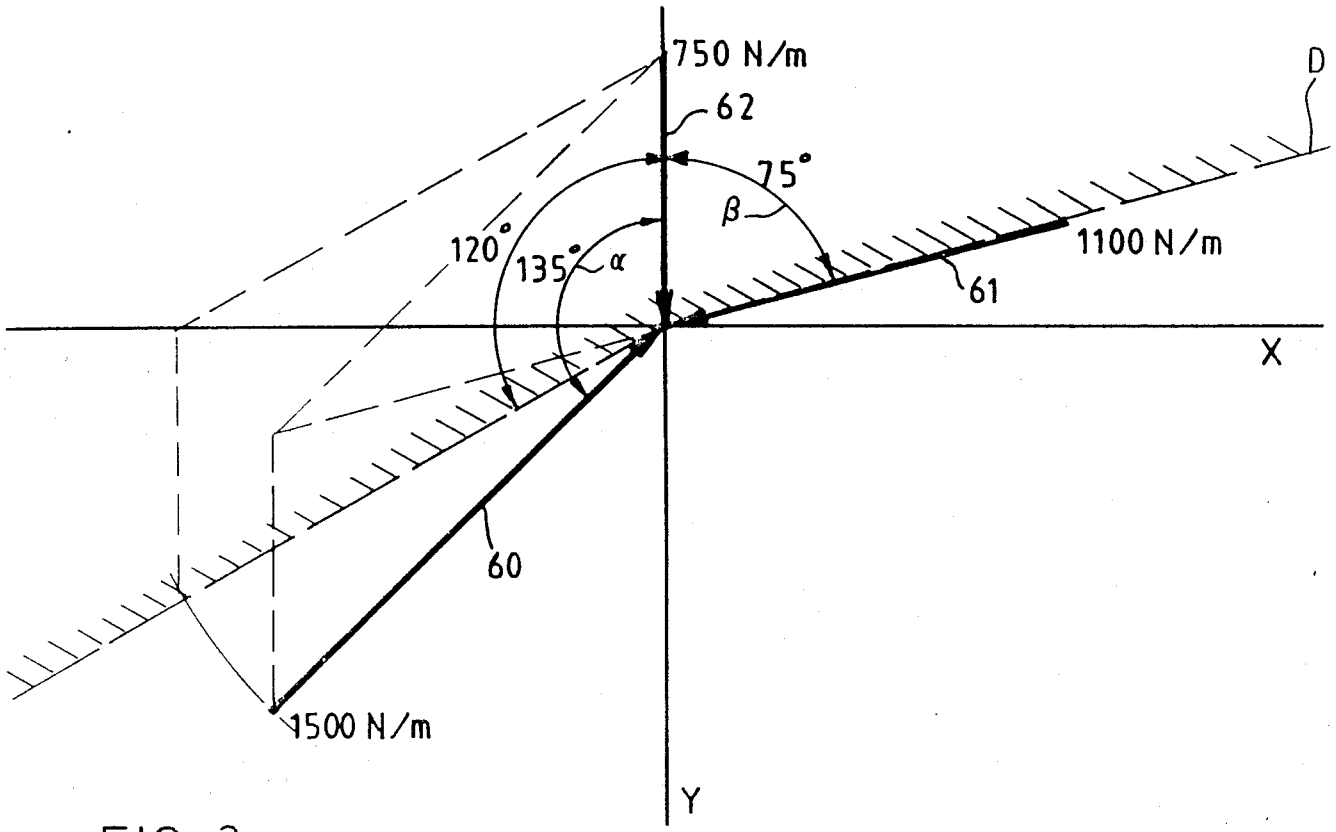
FIG. 3 is a force diagram of the magnitude and the direction of the various forces which can be exerted on a transfer roller.

The relationship between the magnitude and direction of the forces which are exerted on the image transfer roller is shown in the force diagram of FIG. 3. This diagram shows a system of coordinates with the center point of the image transfer roller as the center and the radial line of the image transfer roller which passes through the contact zone between this roller and the photoconductive drum as the y-axis. The vectors 60 and 61 represent the forces exerted on the image transfer roller 25 by the pressure roller 31 and the cleaning roller 34, respectively, and are shown in the system of coordinates at angles of 135° (angle $\beta$) and 75° (angle $\beta$). The force vector that the cleaning roller 34 must exert in the third contact zone 25*c* and which is required to obtain a zero resultant of the forces exerted on the image transfer roller 25 at the axis of rotation thereof is determined from the magnitude and direction of the force vector 62 in the first contact zone 25*a* and the magnitude and direction of the force vector 60 in the second contact zone 25*b*.

The area above lines C and D is the area in which there are no usable directions of the force vectors 60 and 61. Starting from a force vector 60 of 1500 N/m and a force vector 62 of 750 N/m, a good setting at which no extremely high compensating force vector 61 has to be applied is obtained by setting the angle $\alpha$ between 130° and 140° and the angle $\beta$ to 75°. With a transfer/-fixing pressure of 1500 N/m the magnitude of the compensating force that the cleaning roller must apply to achieve an equilibrium of forces is then between about 1050 and 1150 N/m.

While a presently preferred embodiment of practicing the invention has been shown and described with particularity in connection with the accompanying drawings, the invention may otherwise be embodied within the scope of the following claims.

What is claimed is:

1. A transfer device for transferring a powder image from an image support to a receiving material and fixing the powder image thereon, comprising: a rotatable transfer roller, a plurality of other rollers, including at least a first roller, a second roller and a third roller, each having an axis of rotation substantially parallel to an axis of rotation of the transfer roller, which are pressed against the transfer roller by a plurality of forces to form a plurality of contact zones, including at least a first contact zone, a second contact zone and a third contact zone, respectively, wherein the resultant of the forces by which the plurality of other rollers are pressed against the transfer roller is substantially equal to zero at the axis of rotation of the transfer roller.

2. A device as described in claim 1 wherein the plurality of other rollers comprises only three rollers.

3. A device as described in claim 1 wherein the first contact zone is for transferring the powder image from the image support to the transfer roller.

4. A device as described in claim 3 wherein the second contact zone is for transferring the powder image from the transfer roller to the receiving material.

5. A device as described in claim 4 wherein the first roller is a photoconductive drum on which a powder image can be formed and the second roller is a pressure roller which presses the receiving material against the transfer roller.

6. A device as described in claim 1 wherein the plurality of other rollers are so shaped and pressed against the transfer roller that the contact zones formed thereby are substantially straight when considered in a longitudinal direction.

7. A device as described in claim 6 wherein at least one of the other rollers is barrel-shaped such that the force with which that roller presses into contact with the transfer roller is exerted on its ends.

8. A device as described in claim 6 wherein at least one support roller is provided for pressing one of the other rollers against the transfer roller, the support roller being cambered such that the force with which that roller is pressed is exerted on its ends.

9. A device as described in claim 1 wherein the angle between a first radial plane of the transfer roller which extend through the axis of rotation of the first roller and a second radial plane of the transfer roller which extends through the axis of rotation of the second roller is between 130° and 140°, and the angle between the first radial plane and a third radial plane of the transfer roller which extends through the axis of rotation of the third roller is at least 75°.

10. A device as described in claim 9 wherein the angle between the first radial plane and the third radial plane is 75°.

11. A device as described in claim 9 wherein the angle between the first radial plane and the second radial plane is 135°.

12. A device as described in claim 1 wherein the plurality of other rollers are pressed against the transfer roller by means of a plurality of springs wherein a rotatable element is mounted on the transfer roller and is provided with a plurality of cams which, upon rotation of the element, can bring either the first roller, the second roller, or the third roller, respectively, out of contact with the transfer roller.

13. A device as described in claim 12 wherein the cams are located on the rotatable element in such a way that, depending upon the position of the rotatable element, only the first other roller, only the second other roller or both the first, second and third other rollers are out of contact with the transfer roller.

* * * * *